United States Patent [19]

Abraham et al.

[11] Patent Number: 4,669,704

[45] Date of Patent: Jun. 2, 1987

[54] METHOD AND APPARATUS FOR JACKING BASEMENT WALLS

[75] Inventors: Robert S. Abraham, Wild Rose; Dennis L. Koehler, Neenah, both of Wis.

[73] Assignee: Abe-Jack Systems, Inc., Wild Rose, Wis.

[21] Appl. No.: 835,519

[22] Filed: Mar. 3, 1986

[51] Int. Cl.[4] ..... B66F 11/00

[52] U.S. Cl. ..... 254/100; 254/133 R

[58] Field of Search ..... 254/98, 100–101, 254/133 R, 133 A, 134; 405/282

[56] References Cited

U.S. PATENT DOCUMENTS

| | | | |
|---|---|---|---|
| 587,274 | 7/1897 | Rue | 254/101 |
| 737,133 | 8/1903 | O'Brien | 254/133 A |
| 2,684,824 | 7/1954 | Hillberg | 254/100 X |
| 2,850,254 | 9/1958 | Houseworth | 254/100 |
| 2,885,221 | 5/1959 | Weeks | 254/100 X |
| 4,453,863 | 6/1984 | Sutton et al. | 405/282 |
| 4,472,090 | 9/1984 | Krings | 405/282 X |

FOREIGN PATENT DOCUMENTS

| | | | |
|---|---|---|---|
| 2207319 | 1/1987 | Fed. Rep. of Germany | 405/282 |

*Primary Examiner*—Frederick R. Schmidt
*Assistant Examiner*—Steven P. Schad
*Attorney, Agent, or Firm*—Nicholas A. Kees

[57] ABSTRACT

An apparatus and method for jacking basement walls which have cracked or partially moved inward due to pressure from outside the wall. Employing the apparatus of this invention, the jacking operation can be done easily and safely even in basements where there is little space along the wall in which to fit jacking equipment. The apparatus includes a brace attached at the bottom by a bracket adjacent the wall to be jacked. The brace is then set vertically against the wall. A telescoping beam is attached to the floor a short distance from the wall, so that the beam is positioned upright, parallel to the brace. The upper end of the beam is extended and attached to the floor joists overhead in the basement. A jack assembly is then slidably attached between the beam and the brace. The jack assembly may then be slid to the proper point to exert pressure on the brace, and in turn the wall, at the best possible spot. Once the wall is moved back into its proper place, the top of the brace is affixed to the floor joists so as to prevent the wall from moving back out of position.

7 Claims, 6 Drawing Figures

METHOD AND APPARATUS FOR JACKING BASEMENT WALLS

BACKGROUND OF THE INVENTION

This invention relates to a method and apparatus for forcing a basement wall back out to its original position after pressure from the outside of the wall has moved it inward improperly. In particular, the invention relates to a wall jacking system which can be employed in a minimum of space and with a minimum of effort by the operator without sacrificing safety.

Systems for jacking walls have been known for many years. For instance, Rue, U.S. Pat. No. 543,056, discloses a device for jacking the walls of a ditch by use of a screw-threaded shaft. This device, however, would not work for jacking basement walls since it is designed to jack against an opposing wall only. In a basement it is not unusual for the nearest opposing wall to be up to fifty feet or more away from the wall to be jacked. Further, that opposing wall may itself be in need of jacking, making it undesirable as an anchor against which to jack the first wall. Alternatively, the opposing wall may be an internal dividing wall, whether constructed of block or even studs and drywall. Such a wall would simply not provide sufficient jacking force to move the first wall outward. What is needed then is a jack which does not require an opposing wall nearby able to apply substantial jacking force.

The apparatus disclosed in Carroll, U.S. Pat. No. 1,578,230, and particularly at FIG. 6 thereof, does provide support for a basement wall to be poured without tne necessity of a nearby opposing wall. Because of the nature of the intended use of the Carroll apparatus, however, it is not very flexible or adaptable to different situations, and it does not make use of any overhead support which is always available when jacking an existing basement wall. Making use of such overhead support would not only provide more flexibility, but would also result in more even pressure on the wall, improving the safety of the operation.

This invention relates to improvements over the devices referred to above and solutions to the problems raised thereby.

SUMMARY OF THE INVENTION

In the present invention an apparatus is provided to supply pressure over a relatively distributed portion of a basement wall which has been moved inward by pressure from the earth outside, in order to return the wall to its original position. The apparatus includes a bracket attached to the floor at the base of the wall to be jacked. A wall brace or other beam is then fitted into this bracket and placed against the wall vertically. A suitable distance away from the wall another bracket is secured to the floor. Secured to or integrally formed with the second bracket is an upstanding beam which is an elongated telescoping member. Its length is adjusted so that it reaches up to the floor joists overhead, where the top of the beam is secured. Thus the telescoping member and the wall brace reach from floor to ceiling in the basement and are approximately parallel to each other, vertical and spaced apart. Slidably attached between the telescoping member and the wall brace is a jack member, whic :s attached to each at a respective end. The jack member is telescopable by turning a wheel, handle or other leverage-increasing device which causes threaded shafts in the jack member to move outward, exerting force outward on the inside of the basement wall, until the basement wall has been pushed back into position. The upper end of the wall brace is then secured to the floor joists to ensure that the wall is held in place when the jack member is then removed. Since the jack member can be slid up and down the wall brace and vertical telescoping member, pressure can be exerted at any point necessary along the wall, giving great flexibility and safety in use.

It is thus an object of this invention to provide an apparatus for jacking basement walls including a telescoping jack member slidably attached between two vertical members, one being a beam fastened to the basement floor and braced in the floor joists overhead to provide support and the other positioned against the wall to be restored to its original position.

A more specific object of the invention is to provide an apparatus as referred to above wherein the beam member is vertically telescopable so as to accommodate different size basements.

Other objects and advantages of the invention will become apparent hereinafter.

DESCRIPTION OF THE PREFERRED EMBODIMENTS

Figure 1:
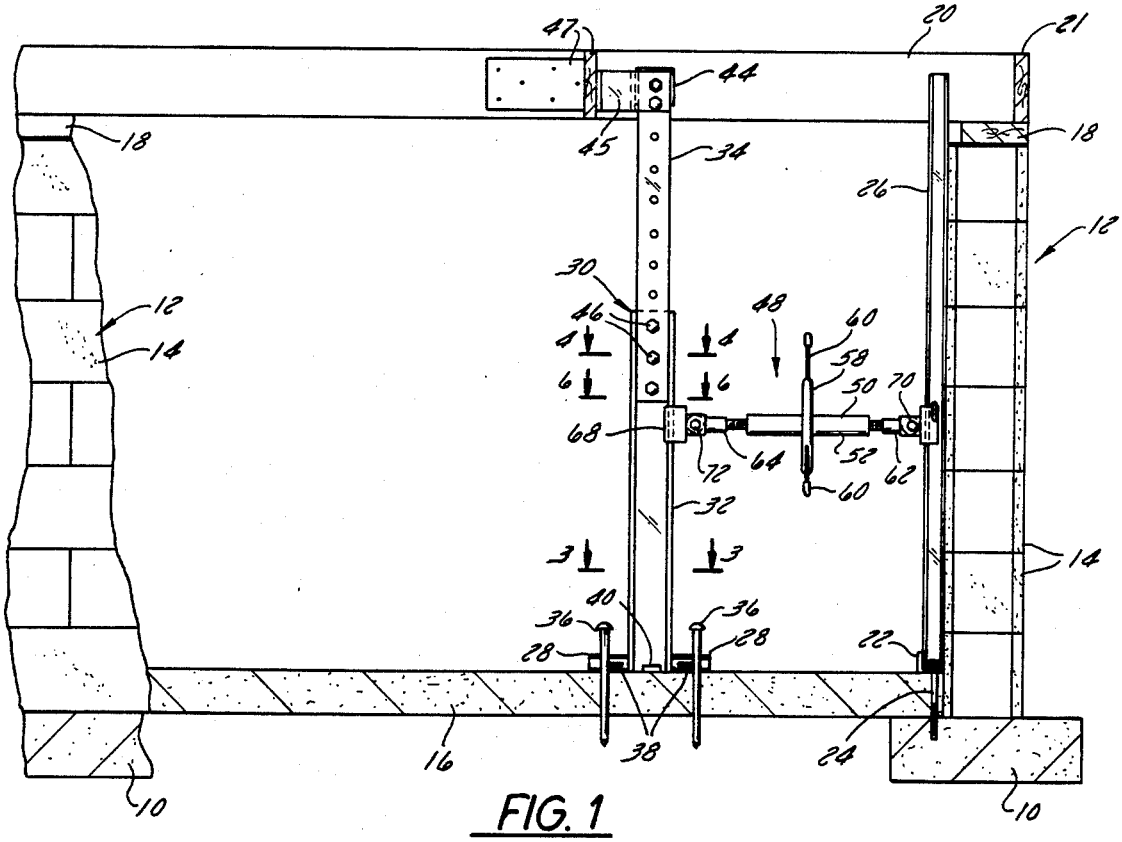
FIG. 1 is an elevational view of a basement showing one embodiment of the invention.

Referring now to FIG. 1, there is shown a conventionally constructed basement having, at its lowest point, footings 10 resting on the soil (not shown) beneath the subject building. While footings 10 are not the least necessary for the operation of the invention disclosed herein, they are shown here for completeness because most, although by no means all, basements were constructed using them. A vertical wall 12 has been constructed thereon. The type of wall shown is constructed of concrete blocks 14, but the particular material is irrelevant and could include poured concrete walls, wood foundation walls or any other suitable material. A basement floor 16, the edges of which rest on footing 10 has also been constructed of poured concrete but again the material is irrelevant. Atop the wall 12 are sill plates 18, on which in turn rest a plurality of floor joists 20 and an end plate 21 at each end of the floor joists 20.

Figure 2:
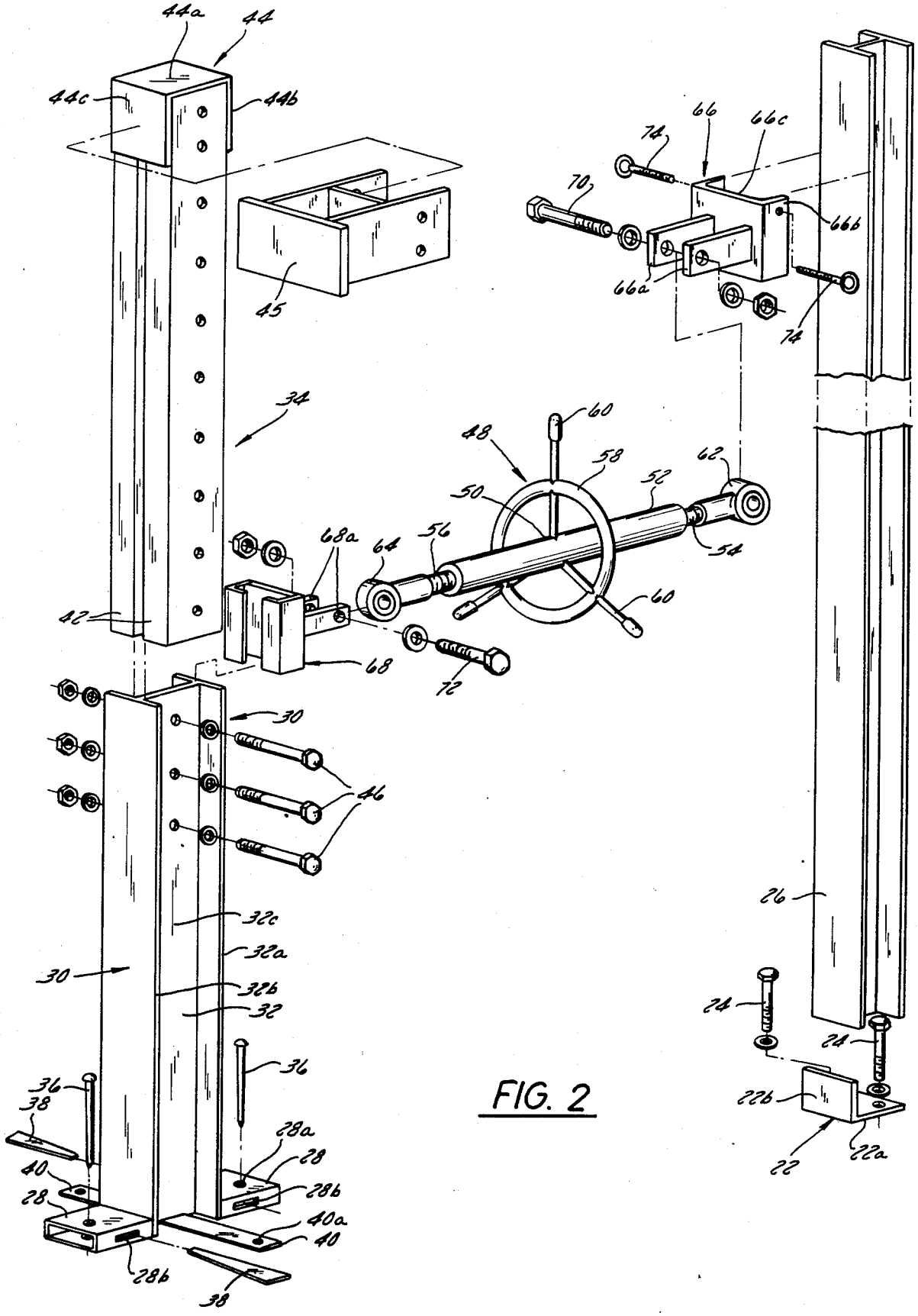
FIG. 2 is an exploded isometric view of the apparatus of the embodiment shown in FIG. 1.

As can be seen by comparing FIG. 1 and FIG. 2, a bracing angle bracket 22 is first attached to the floor 16 at the base of the wall 12 by inserting several bolts 24 through holes in the bottom portion **22*a* of bracket 22, through floor 16 and into the footing 10. Preferably holes have previously been drilled in floor 16 and footing 10, and cement poured therein. Then when bolts 24** are inserted, the cement dries around the threads, resulting in long-lasting holding power. The upright portion 22*b* of bracket 22 is positioned opposite the wall 12. The bracket is sized so that a vertical wall brace 26 such as an I-beam can just be inserted between the upright portion 22*b* and the wall 12. The brace 26 is thus placed on bracket 22 and arranged vertically against the wall 12.

Figure 3:
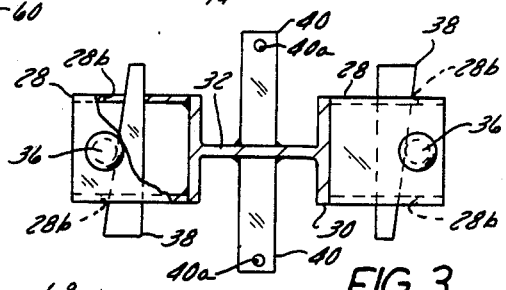
FIG. 3 is an enlarged cross-sectional view of the embodiment shown in FIG. 1 taken along line 3—3.

Secured to the floor 16 a suitable distance away from wall 12 is a second bracket or brackets 28. In turn, secured to or integrally formed with brackets 28 is an upstanding beam 30. Beam 30 includes a base 32 attached to brackets 28 and a telescoping section 34 slidably mounted on base 32. Brackets 28 are secured to the floor preferably by means of pins 36 inserted through holes 28*a* in brackets 28 and driven through floor 16. As shown in FIG. 3, which is a sectional view of beam base 32, showing brackets 28 attached thereto, a pair of wedges 38 are inserted into slots 28*b* in the sides of brackets 28. Since slots 28*b* are slightly offset from holes 28*a*, the wedges 38 slide by the pins 36 and lock the pins tightly into place in the brackets 28. Preferably wedges 38 are inserted from opposite sides of the brackets 28, and forced into the slots as far as possible so as to make the attachment of beam base 32 to the floor 16 as stable and sturdy as possible. Also attached to or formed integrally with the bottom end of beam base 32 are a pair of stabilizers 40. These stabilizers 40 are preferably attached perpendicular to base 32 at its bottom, and extend a short distance outward along the floor 16. The purpose of these stabilizers 40 is mainly to stabilize base 32 before it is attached to the floor 16, to keep it from falling over until attached. However, each stabilizer 40 is also provided with a hole 40*a* so that a pin (not shown) can also be driven therethrough and into the floor 16, to give extra support in cases where, for instance, floor 16 is unusually thin, or in any case where additional support is desired.

Figure 4:
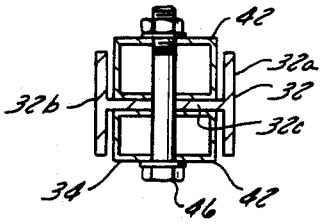
FIG. 4 is an enlarged cross-sectional view of the embodiment shown in FIG. 1 taken along line 4—4.

As referred to above, telescoping section 34 of beam 30 slidably engages beam base 32 thereof. While beam 30 may be of any suitably sturdy construction, such as round tube, square tube or rectangular tube, in order to facilitate this sliding engagement, beam base 32 is preferably an I-beam, having flanges 32*a* and 32*b* one at each edge of a center web 32*c*. Accordingly, telescoping section 34 is then preferably made of a pair of identical support members 42 which fit against webbing 32*c* between flanges 32*a* and 32*b* as shown in cross-section in FIG. 4. As shown in FIG. 2, these two members 42 are joined at the top by a connecting piece 44. This connecting piece 44 has a flat portion 44*a* which is connected at the ends of members 42, and side portions 44*b* and 44*c* which reach downward a short distance from the top. Beam base 32 and telescoping section 34 are then connected together by at least two and preferably three bolts 46 inserted transversely through both members 42 and webbing 32*c*. The upper end of beam 30, via a spacer 45 attached to connecting piece 44, is then attached to or braced against the floor joists 20 overhead and supported from behind by suitably sturdy bracing 47 as shown in FIG. 1. The purpose of spacer 45 is to allow it to bear on joists 20 when they are parallel to the wall 12 to be jacked, and still allow sufficient jacking room.

Figure 5:
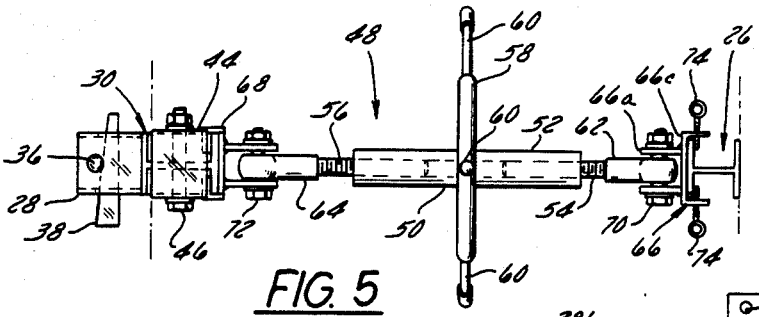
FIG. 5 is an enlarged top view of the embodiment shown in FIG. 1, showing detail of the telescopable jack member and associated connections.
Figure 6:
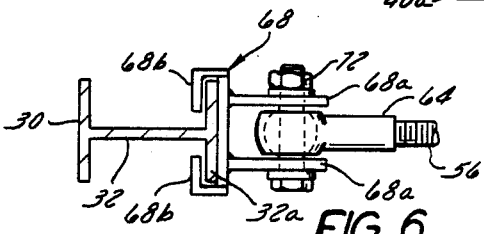
FIG. 6 is an enlarged cross-sectional view of the embodiment shown in FIG. 1 taken along line 6—6.

The next step is to attach a jack assembly 48, shown in FIGS. 1, 2 and 5, between beam 30 and wall brace 26. Although any type of jack having similar characteristics may be used, the most preferred embodiment shows jack assembly 48 to include a screw jack 50 including a barrel 52, the inside of which is threaded in opposite directions at each end. Threaded shafts 54 and 56, having opposing threads, are threaded into the barrel 52. Leverage increasing means, such as a wheel 58 or handles 60 or both, may be attached to the outside of the barrel 52 so as to allow sufficient leverage to turn the barrel 52 and exert significant force outward on the beam 30 and the brace 26, in turn moving the wall 12 back. The distal end of each shaft 54 and 56 terminates in a ball joint rod end 62 and 64, respectively. End 62 is attached to brace connector 66 by a bolt 70 inserted through clevis portion 66*a* thereof and through end 62 itself. Similarly, end 64 is attached to beam connector 68 by a bolt 72 inserted through clevis portion 68*a* thereof and through end 64 itself. That is, brace connector 66 is the part of jack assembly 48 which connects to wall brace 26, while beam connector 68 is the part of jack assembly 48 which connects to telescoping beam 30. Besides clevis portion 68*a*, the balance of beam connector 68 is an I-beam clamp 68*b* which fits slidably over flange 32*a* of beam base 32, as shown best in FIG. 6. Note that beam connector 68 cannot be used at a point on beam 30 above base 32. For this reason, beam base 32 is generally made as long as possible so long as it still fits in the shortest basement the operator is likely to encounter, usually approximately six feet or just under. Since wall brace 26 extends floor-to-ceiling along the basement wall, brace connector 66 is different from beam connector 68. Besides clevis portion 66*a*, brace connector 66 includes a channel 66*b*, shown best in FIGS. 2 and 5. The webbing 66*c* of channel 66*b* is sufficiently wide to fit over the face of brace 26, to contact the web of brace 26. Once channel 66*b* is in position against brace 26, it is held slidably against the brace by any suitable holding means. The means shown in FIGS. 2 and 5 are bolts 74 threaded through the sides of channel 66*b* and behind the flange of brace 26, to contact the web of brace 26. Thus brace connector 66 is installed on brace 26 after beam connector 68 is installed on beam 30, without having to slide the connector 66 on from the end of brace 26. The bolts 74 shown are eyebolts because they are easy to turn by hand once connector 66 is in place, although any suitable type of bolt could be used. The purpose of bolts 74 is to hold the jack assembly 48 from sliding to the floor when the assembly is first installed and before the jacking operation begins. At that time applying pressure with the jack will not keep the jack from falling, since the ground outside wall 12 is usually excavated away, and the wall 12 is thus allowed to move enough to relieve this pressure and fall. The bolts 74 prevent the jacking assembly 48 from falling when the excavation relieves this pressure, because they are screwed through the flange to contact the web of brace 26.

As mentioned above, threaded shafts 54 and 56 both terminate in ball joint rod ends 62 and 64, respectively. The reason for this is that it may be difficult or impossible, depending on conditions in the particular basement, to align wall brace 26 and beam base 32 as is shown in top view in FIG. 5. The more common situation is that the two are installed at a slight offset. Some flexibility is thus required in connecting jack assembly 48 between the brace and the beam, and ball joint rod ends 62 and 64 provide this needed flexibility. This flexibility also ensures that the flat parts of the connectors 66 and 68 apply pressure evenly to the flat parts of beam 30 and brace 26, so as to reduce twisting-moments and improve strength. The fact that the jack assembly 48 is slidable to an extent up and down both brace 26 and beam 30 provides flexibility to the operator in that pressure can be applied to the wall at the point where it is bulging the most and, once that portion is pushed into line, the jack assembly 48 can be easily moved to a different spot along the brace 26 and beam 30 to again apply pressure.

The method of the invention is, first slide-telescoping section 34 onto base 32 to assemble beam 30. Then install base 32 and brackets 28 a suitable distance from the wall 12. Next, extend telescoping section 34 upward and attach it to the floor joists 20 overhead. Then install wall bracket 22, and wall brace 26 thereon, as referred to above, aligned with beam 30 as much as possible. The distance between beam 30 and brace 26 must be sufficiently large to accomodate the later installation of jack assembly 48 therebetween, yet small enough that the jack assembly 48 has substantial travel available to it after installation. The jack assembly 48 is then installed between beam 30 and brace 26, as described above. Using handles 60 or wheel 58, or both, the operator then operates the jack assembly 48 to force brace 26, and in turn wall 12, outward to the proper position. Since the bottom of brace 26 is held by brackets 22, the top of the I-beam moves as the wall is jacked. When the wall reaches its proper position, the top of brace 26 is secured to the overhead floor joists 20 in any suitable manner so as to prevent the wall from moving back in again.

While the method and apparatus hereinbefore described is effectively adapted to fulfill the aforesaid objects, it is to be understood that the invention is not intended to be limited to the particular preferred embodiments of basement wall jacking apparatus and method herein set forth. Rather, it is to be taken as including all reasonable equivalents without departing from the scope of the appended claims.

We claim:

1. Apparatus for jacking outward the wall of a basement comprising a footing, a vertical wall resting on said footing, said wall having moved inward out of its proper position, a floor also supported at its edges by said footing, and a plurality of floor joists resting on top of said wall, said apparatus comprising:

a vertical wall brace having a top end and a bottom end, said bottom end is provided with means for attaching to said floor adjacent to said wall to be jacked in such a manner to permit movement of the brace;

an upstanding beam with means for removably attaching to said floor a suitable distance from said wall to be jacked, said beam being telescopable and provided with with means such that its upper end is removably attachable to said floor joists; and a jacking assembly having two ends, one end slidably attached to said wall brace, the opposite end slidably attached to said upstanding beam, for moving said brace and in turn said wall outward back to its proper position;

such that when said wall has reached its proper position, the top end of said brace is attached to said floor joists to keep said wall in said proper position.

2. Jacking apparatus as recited in claim 1 wherein said telescopable beam includes a base attached to said floor, a telescoping section slidably connected therewith and means for attaching said telescoping section to said base.

3. Jacking apparatus as recited in claim 2 wherein said base is an I-beam with a web and two flanges, one flange connected to each edge of said web, and wherein said telescoping member comprises a pair of support members each fitting against a respective side of said web and between said flanges, said support members joined at their top ends only by a connecting piece.

4. Jacking apparatus as recited in claims 1 or 3 wherein said jacking assembly includes an I-beam clamp, pivotably connected to one end thereof by clevis means, for slidably attaching said jacking assembly to said beam, a channel pivotably connected to the opposite end thereof by clevis means, for fitting over said brace, and holding means for holding said channel slidably against said brace after placement.

5. Jacking apparatus as recited in claim 1 or 3 wherein said jacking assembly includes a barrel, one or more handles attached to the outside of said barrel, and two threaded shafts, threaded in opposite directions into each end of said barrel, such that as said barrel is turned in one direction by use of said handles, said shafts move outward exerting outward pressure on said wall brace and said upstanding beam.

6. Jacking apparatus as recited in claim 5 wherein the distal ends of said threaded shafts each terminate in a ball joint rod end, and wherein said jacking assembly further includes an I-beam clamp, pivotably connected to one of said rod ends by clevis means for slidably attaching said jack assembly to said beam, a channel pivotably connected to the other of said rod ends by clevis means, for fitting over said brace, and holding means for holding said channel slidably against said brace after placement.

7. A method for jacking outward the wall of a basement comprising a footing, a vertical wall resting on said footing, said wall having moved inward out of its proper position, a floor supported at its edges by said footing, and a plurality of floor joists resting on top of said wall, by use of apparatus comprising:

a vertical wall brace having a top end and a bottom end;

an elongated beam, telescopable lengthwise, having means at one end for attaching it to said floor and means at the opposite end for connection to said floor joists; and a jacking assembly having two ends;

said method comprising the steps of:

attaching said beam to said floor a suitable distance from said wall by use of said attaching means;

extending said beam upward and connecting the top end thereof to said floor joists;

attaching the bottom end of said vertical wall brace to said floor adjacent said wall to be jacked and aligning said brace vertically against said wall;

installing said jacking assembly between said beam and said brace, each of said two ends of said jacking assembly being attached to one of said beam and said brace;

operating said jack thereby moving said brace and in turn said wall outward until said wall is again in its proper position; and attaching the top end of said brace to said floor joists so as to prevent said wall from again moving out of position.

* * * * *